US006534233B1

(12) United States Patent
Yamamoto et al.

(10) Patent No.: US 6,534,233 B1
(45) Date of Patent: Mar. 18, 2003

(54) METHOD FOR PRODUCING TONER

(75) Inventors: Hiroshi Yamamoto, Kamakura (JP); Kazuhiro Sato, Kawasaki (JP); Makoto Watanabe, Tokyo (JP); Hidetoshi Azuma, Tokuyama (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 09/912,502

(22) Filed: Jul. 26, 2001

(30) Foreign Application Priority Data

Jul. 28, 2000 (JP) ..... 2000-229318

(51) Int. Cl.[7] ..... G03G 9/00
(52) U.S. Cl. ..... 430/137.171
(58) Field of Search ..... 430/137.17

(56) References Cited

U.S. PATENT DOCUMENTS 4,521,505 A * 6/1985 Podszun et al. ..... 430/112
5,567,566 A * 10/1996 Mahabadi et al. ..... 430/137
6,132,919 A 10/2000 Ogawa et al. ..... 430/110
6,203,957 B1 * 3/2001 Nomura et al. ..... 430/110

FOREIGN PATENT DOCUMENTS

JP 6-75429 3/1994

* cited by examiner

*Primary Examiner*—John Goodrow
(74) *Attorney, Agent, or Firm*—Armstrong, Westerman & Hattori, LLP

(57) ABSTRACT

A toner can be produced by dispersing a colorant in a dispersion medium essentially composed of a polymerizable monomer by using a media-type dispersing device at a tip speed of a stirring body of 3 to 20 m/s with a residence time being 0.03 to 0.5 hour to obtain a monomer composition A; dispersing or dissolving a charge control agent in a dispersion medium to obtain a monomer composition B; dispersing or dissolving a parting agent in a dispersion medium to obtain a monomer composition C; mixing or dispersing the monomer composition A, the monomer composition B and the monomer composition C in a dispersion medium to obtain a polymerizable composition D; and homogenizing the composition D in an aqueous dispersion medium containing a dispersion stabilizer to generate droplets; polymerizing the droplets to obtain colored polymer particles; and attaching an outer-additive on the colored polymer particles.

20 Claims, No Drawings

METHOD FOR PRODUCING TONER

BACKGROUND OF THE INVENTION

The present invention relates to methods for producing toners for use in developing electrostatic images to be formed by an electrophotography, electrostatic recording process and other processes, and, more particularly, to a method which is capable of efficiently producing a toner having a narrow particle diameter distribution and causing a low degree of printing fog.

A toner to be used in an electrophotography apparatus, an electrostatic recording apparatus or another apparatus has been produced by various types of methods. To take an example, a classifying method (namely, crushing method) in which, after a colorant, a charge control agent, an offset preventing agent and other agents are uniformly dispersed in a thermoplastic resin by melt-kneading processing, the resultant resin was crushed to produce particles having a desired particle diameter. Another known example is the method (namely, polymerization method) in which droplets of a monomer composition containing a colorant and other additives are polymerized and optionally aggregated to directly produce toner particles.

In such the polymerization methods, characteristics of toner particles to be obtained depend on the uniformity of fine droplets of the monomer composition containing a colorant and other agents.

As a method for producing the monomer composition, a method of dispersing such that a viscosity change of more than 10 times an initial viscosity can be attained by using a media-type dispersing device has been proposed (Japanese Patent Laid-Open No. 75429/1994). However, even if a dispersion which has been subjected to such a large viscosity change is polymerized, the obtained toners have a wide particle diameter distribution, whereupon in a long period of operation, a fog on a light-sensitive material or paper can occur to deteriorate image characteristics.

SUMMARY OF THE INVENTION

An object of the present invention is to provide a method of efficiently producing a toner which has a narrow particle diameter distribution and generates minimal fog.

As a result of an extensive study by the present inventors for overcoming various problems in a method for producing a toner by a polymerization method, the present inventors have found that a toner which has a narrow particle diameter distribution and does not cause a fog can be produced by conducting a step of dispersing a colorant and other additives in a polymerizable monomer by using a media-type dispersing device with a specified rotation speed in a specified period of residence time and, being based on the above finding, have achieved the present invention.

Thus, according to the present invention, there is provided a method for producing a toner comprising the steps of: dispersing a colorant in a dispersion medium, essentially composed of a polymerizable monomer, by using a media-type dispersing device at a rate of the tip of a stirring body of 3 to 20 m/s with a residence time being 0.03 to 0.5 hour to obtain a monomer composition A; homogenizing the above-described composition A in an aqueous dispersion medium containing a dispersion stabilizer to generate droplets; and polymerizing the above-described droplets to obtain colored polymer particles.

Further, according to the present invention, there is provided a method for producing a toner comprising the steps of: dispersing a colorant in a dispersion medium (a), essentially composed of a polymerizable monomer, to obtain a monomer composition A; dispersing or dissolving a charge control agent in a dispersion medium (b), essentially composed of a polymerizable monomer, to obtain a monomer composition B; dispersing or dissolving a lubricant in a dispersion medium (c), essentially composed of a polymerizable monomer, to obtain a monomer composition C; dispersing or mixing the monomer composition A, the monomer composition B and the monomer composition C in a dispersion medium (d), essentially composed of a polymerizable monomer, to obtain a polymerizable composition D; homogenizing to form droplets of the above-described polymerizable composition D in an aqueous dispersion medium containing a dispersion stabilizer; and polymerizing the above-described droplets to obtain colored polymer particles.

DETAILED DESCRIPTION OF THE INVENTION

A production method for toner according to the present invention comprises the steps of: dispersing a colorant in a dispersion medium, essentially composed of a polymerizable monomer, using a media-type dispersing device at a tip speed of a stirring body of 3 to 20 m/s with a residence time being 0.03 to 0.5 hour to obtain a monomer composition A; homogenizing the above-described composition A in an aqueous dispersion medium containing a dispersion stabilizer to generate droplets; and polymerizing the above-described droplets to obtain colored polymer particles.

The media-type dispersing device for use in the dispersing steps of the production method according to the present invention comprises a stator and a stirring body wherein the stator is provided with an opening for introducing materials and an opening for discharging medium, colorant and so on; the stirring body is disposed in the stator in a rotatable manner; media is filled in a space formed by the stator and the stirring body such that the media can move with rotation of the stirring body.

As the media-type dispersing device, there are various types such as a horizontal cylinder type, a vertical cylinder type, and an inverted triangle type, depending on a shape or disposing manner of the stator. Specific examples are a horizontal, cylindrical media-type dispersing device; vertical, cylindrical media-type dispersing device; and an inverted-triangle, annular media-type dispersing device.

Specific examples of the above-described media-type dispersing devices include Attritor (available from Mitsui Mining Co.), Mighty Mill (available from Inoue Seisakusho Co.), Diamond Fine Mill (available from Mitsubishi Heavy Inds.), Dyno-Mill (available from Shinmaru Enterprises Corp.), Apex Mill (available from Kotobuki Engineering & Mfg. Co.) and other mills. Among these, a horizontal, cylindrical media-type dispersing device such as Dyno-Mill is preferable for the production method according to the present invention since it is of a horizontal type and can perform a favorable dispersion while suppressing a viscosity change.

As media filled in a media-type dispersing device, beads which are excellent in abrasion resistance are used. The diameter of a single bead is ordinarily 0.1 to 20 mm, preferably 0.3 to 10 mm, and more preferably 0.5 to 3 mm. The density of the bead is ordinarily 3 to 9 g/cm$^3$, preferably 4.5 to 7.5g/cm$^3$. Materials used for beads, and ceramics having high hardness such as zircon, zirconia and other ceramic products and metals having high hardness such as steel and other iron products are preferably used. Taking grinding efficiency into consideration, the apparent filling volume of the media in the dispersing device is ordinarily 50 to 90% by volume, preferably 60 to 85% by volume.

In the present invention, it is necessary to set a tip speed of a stirring body at 3 to 20 m/s, preferably 8 to 20 m/s. Also in the present invention, a residence time of the monomer composition A to be dispersed by the media-type dispersing device is 0.03 to 0.5 hour, preferably 0.05 to 0.3 hour. By setting such tip speed (rotation rate) and residence time, a toner which is excellent in an electric charge amount distribution and does not cause a printing fog can be obtained.

In a preferred production method according to the present invention, a supply amount of the monomer composition A passing through the media-type dispersing device is set to be at an apparent linear velocity of ordinarily 0.005 to 2 m/min, preferably 0.01 to 1 m/min. In order to set the apparent velocity to be within these ranges, the monomer composition A to be discharged from the media-type dispersing device may be circulated by leading it into an inlet of the dispersing device. A volume of the monomer composition A to be held in the dispersing device is ordinarily 10 to 50% by volume, preferably 15 to 40% by volume.

The apparent linear velocity is calculated by the following expression:

(Apparent linear velocity[m/min])=(fluid flow[$m^3$/min])/(cross sectional area of the stator[$m^2$])

A temperature of the monomer composition A in the dispersing device is ordinarily 0 to 50° C., preferably 20 to 45° C. By setting the temperature to be within the range, a toner which is excellent in a charge amount distribution and does not cause a printing fog can be obtained.

In the production method according to the present invention, a viscosity of the monomer composition A after being dispersed is less than 10 times, preferably 1 time to 8 times as much as that of the monomer composition A before being dispersed, namely, an initial viscosity thereof. By suppressing a viscosity change, a toner excellent in the electric charge amount distribution can easily be obtained.

The dispersion medium according to the present invention is essentially composed of a polymerizable monomer.

As a main component of the polymerizable monomer, a monovinyl monomer can be used. The polymerizable monomer is subjected to polymerization to be a binding resin component in a colored polymer particle.

Specific examples of monovinyl monomers include styrene monomers such as styrene, 4-methylstyrene, and α-methylstyrene; unsaturated carboxylic acid monomers such as acrylic acid, and methacrylic acid; unsaturated carboxylic acid ester monomers such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, and dimethylaminoethyl methacrylate; unsaturated carboxylic acid derivatives such as acrylonitrile, methacrylnitrile, acrylamide, and methacrylamide; ethylenically unsaturated monoolefins such as ethylene, propylene, and butylene; halogenated vinyl monomers such as vinyl chloride, vinylidene chloride, and vinyl fluoride; vinyl esters such as vinyl acetate, and vinyl propionate; vinyl ethers such as vinyl methyl ether, and vinyl ethyl ether; vinyl ketone monomers such as vinyl methyl ketone, and methyl isopropyl ketone; nitrogen-containing vinyl monomers such as 2-vinylpyridine, 4-vinylpyridine, and N-vinylpyrrolidone. These monovinyl monomers may be used either individually or in any combination thereof. Among these monovinyl monomers, styrene monomers, unsaturated carboxylic acid monomers, unsaturated carboxylic acid esters, and unsaturated carboxylic acid derivatives are preferably used. Particularly, styrene monomers and ethylenically unsaturated carboxylic acid ester monomers are favorably used.

By using an optional crosslinkable monomer as a polymerizable monomer together with any one of these monovinyl monomers, fixing ability and, particularly, offset resistance are enhanced.

As crosslinkable monomers, there are for example, aromatic divinyl compounds such as divinylbenzene, divinylnaphthalene and derivatives thereof; polyfunctional ethylenically unsaturated carboxylic acid esters such as ethylene glycol dimethacrylate, and diethylene glycol dimethacrylate; N,N-divinylaniline and divinyl ether; and compounds having at least three vinyl groups. These crosslinkable monomers may be used either individually or in any combination thereof. It is desirable that these crosslinkable monomers are used in a proportion of ordinarily 0.05 to 5 parts by weight, preferably 0.1 to 2 parts by weight, based on 100 parts by weight of the monovinyl monomers.

Further, in the present invention, a macromonomer may be used as a polymerizable monomer. The macromonomer has a polymerizable vinyl functional group at the molecular chain terminal thereof and is an oligomer or polymer having a number average molecular weight of ordinarily 1,000 to 30,000.

As the polymerizable vinyl functional group which the macromonomer has at the molecular chain terminal thereof, mentioned are an acryloyl group and a methacryloyl group, with the methacryloyl group being preferred for ease of copolymerization.

An amount of the macromonomer used is ordinarily 0.01 to 10 parts by weight, preferably 0.03 to 5 parts by weight, more preferably 0.05 to 1 part by weight, based on 100 parts by weight of the monovinyl monomer. As long as the amount of the macromonomer is within these ranges, a more favorable balance between shelf stability and fixing ability can be obtained.

A colorant is dispersed in the above-described dispersion medium. Conventional dyes or pigments as colorants for toners may be used.

Examples of black colorants include pigments such as carbon black, and nigrosine-base dyes; magnetic particles such as cobalt, nickel, triiron tetraoxide, manganese iron oxide, zinc iron oxide and nickel iron oxide. Where carbon black is used, it is preferable to use carbon black having a primary particle diameter of 20 to 40 nm since an image quality can be enhanced and also an enviromentally friendly toner is obtained.

As colorants for use in color toners, there are yellow colorants, magenta colorants, and cyan colorants.

As yellow colorants, compounds such as azo pigments, and condensation polycyclic pigments are used. Specifically mentioned as examples thereof are C. I. Pigment Yellow No.3, 12, 13, 14, 15, 17, 62, 65, 73, 83, 90, 93, 97, 120, 138, 155, 180, 181, 185, and 186.

As magenta colorants, compounds such as azo pigments and condensation polycyclic pigments are used. Specifically mentioned as examples thereof are C. I. Pigment Red No.48, 57, 58, 60, 63, 64, 68, 81, 83, 87, 88, 89, 90, 112, 114, 122, 123, 144, 146, 149, 163, 170, 184, 185, 187, 202, 206, 207, 209, 251, and C. I. Pigment Violet No.19.

As cyan colorants, compounds such as copper phthalocyanine compounds and the derivatives thereof, anthraquinone compounds are used. Specifically mentioned as examples thereof are C. I. Pigment Blue No.2, 3, 6, 15, 15:1, 15:2, 15:3, 15:4, 16, 17, and 60.

These colorants are used in a proportion of ordinarily 0.1 to 50 parts by weight, preferably 1 to 20 parts by weight, based on 100 parts by weight of entire polymerizable monomers (whole quantity of polymerizable monomers to be used for obtaining colored polymer particles). An amount of dispersion medium in the monomer composition A is 40 to 99% by weight, and preferably 70 to 95% by weight.

Further, for a purpose of uniform dispersion of the colorant in toner particles, a lubricant such as oleic acid and stearic acid; a dispersion assistant such as a silane coupling agent and a titanium coupling agent; a polar group-containing polymer dispersion assistant; and other agents may be present in the monomer composition A. Such a lubricant or dispersion assistant or both are ordinarily used in a proportion of approximately 1/1000 to 1/2, based on the weight of the colorant.

An average dispersed particle diameter of the colorant or other agents in the dispersion medium after dispersion processing according to the present invention is preferably 1 $\mu$m or less, more preferably 0.5, $\mu$m or less.

In the production method according to the present invention, in order to control characteristics of toner particles to be obtained, other agents such as a charge control agent, a molecular weight control agent, a parting agent and other compounding agents can be used. These agents can be dispersed or dissolved in the dispersion medium similar to that described above separately from the colorant or in the above-described monomer composition A. In the production method according to the present invention, it is particularly preferable that the charge control agent is dispersed in the dispersion medium similar to that described above by, optionally, using the media-type dispersing device thereby preparing the monomer composition B, the parting agent is dissolved in the dispersion medium similar to that described above or dispersed by, optionally using a media-type dispersing device thereby preparing a monomer composition C, and then the monomer composition A, the monomer composition B and the monomer composition C are mixed or dispersed in the dispersing medium similar to that described above by, optionally, using the media-type dispersing device to obtain a polymerizable composition D.

As the charge control agent to be used in the present invention, various types of positively chargeable charge control agents or negatively chargeable charge control agents can be used. For example, metal complexes of organic compounds having a carboxyl group or nitrogen-containing group, metal-containing dyes, and nigrosine can be used. More specifically, charge control agent such as Spiron Black TRH and T-77 (both available from Hodogaya Chemical Co., Ltd.), Bontron S-34, Bontron E-84 and Bontron N-01 (all available from Orient Chemical Industries Ltd.), and Copy Blue-PR (available from Clariant Ltd.); and/or charge control resins such as quaternary ammonium (or ammonium salt) group-containing copolymers, sulfonic acid (or sulfonate)-containing copolymers can be employed. Among the charge control agents, charge control resins are preferable.

An amount of any one or any combination of the above-described charge control agents to be preferably used is ordinarily 0.01 to 10 parts by weight, particularly 0.03 to 8 parts by weight, based on 100 parts by weight of entire polymerizable monomers. An amount of the dispersion medium in the monomer composition B is 70 to 99% by weight, preferably 75 to 95% by weight.

As the parting agent, used are, for example, low molecular weight polyolefin waxes such as low molecular weight polyethylene, low molecular weight polypropylene, and low molecular weight polybutylene; terminal-modified polyolefin waxes such as low-molecular weight polypropylene oxidized at its molecular chain terminal, low-molecular weight polypropylene epoxy-modified at its molecular chain terminal, block polymers of these low-molecular weight polypropylenes with low-molecular weight polyethylene, low-molecular weight polyethylene oxidized at its molecular chain terminal, low-molecular weight polyethylene epoxy-modified at its molecular chain terminal, and block polymers of these low-molecular weight polyethylenes modified at their respective molecular chain terminals with low-molecular weight polypropylene; natural plant waxes such as candelilla, carnauba, rice, Japan wax and jojoba; petroleum waxes such as paraffin, microcrystalline and petrolatum, and modified waxes thereof; mineral waxes such as montan, ceresin and ozokerite; and synthetic waxes such as Fischer-Tropsch wax; polyfunctional ester compounds such as pentaerythritol esters including pentaerythritol tetramyristate, pentaerythritol tetrapalmitate, and pentaerythritol tetralaurate, and dipentaerythritol esters including dipentaerythritol hexamyristate, dipentaerythritol hexapalmitate, and dipentaerythritol hexalaurate.

Among these, synthetic waxes, terminal-modified polyolefin waxes, petroleum waxes and the modified waxes thereof, and polyfunctional ester compounds are preferable. Among the polyfunctional ester compounds, pentaerythritol esters which show endothermic peak temperature upon heating within a range of 30° C. to 200° C., preferably 50° C. to 180° C. and more preferably 60° C. to 160° C. on a DSC curve determined by means of a differential scanning calorimeter (DSC), and dipentaerythritol esters which show endothermic peak temperature within a range of 50° C. to 80° C. are particularly preferable as a toner for the desirable point of a balance between fixing and peeling properties. Among others, dipentaerythritol esters each of which has a molecular weight of 1000 or more, solubility in a proportion of 5 parts by weight or more, based on 100 parts by weight of styrene at 25° C. and an acid value of 10 mg/KOH or less exhibit a distinguished effect in lowering a fixing temperature. The above-described endothermic peak temperatures are values measured in accordance with ASTM D3418-82.

The above-described parting agents are preferably used in a proportion of ordinarily 0.1 to 20 parts by weight, particularly 1 to 15 parts by weight, based on 100 parts by weight of the entire amount of polymerizable monomers. An amount of dispersion medium in the monomer compound C is 70 to 99% by weight, preferably 75 to 95% by weight.

As example molecular weight control agents, mentioned are mercaptans such as t-dodecylmercaptan, n-dodecylmercaptan, n-octylmercaptan, halogenated hydrocarbons such as carbon tetrachloride, and carbon tetrabromide. These molecular weight control agents may be contained in any of the monomer compounds A to C or added in the polymerizable composition before a polymerization is initiated or while a polymerization reaction is progressing. The above-described molecular weight control agents are used in a proportion of ordinarily 0.01 to 10 parts by weight, preferably 0.1 to 5 parts by weight, based on 100 parts by weight of entire polymerizable monomers.

In a homogenizing process according to the present invention, the monomer composition A obtained by the above-described dispersion process, preferably the polymerizable composition D which has been obtained mixing or dispersing the monomer composition A, monomer composition B and monomer composition C in the dispersion medium similar to that described above is changed into droplets in an aqueous dispersion medium containing a dispersion stabilizer.

The aqueous dispersion medium to be used in the present invention is a water-based dispersion medium added with a dispersion stabilizer.

As example dispersion stabilizers, mentioned are sulfates such as barium sulfate, and calcium sulfate; carbonates such as barium carbonate, calcium carbonate and magnesium carbonate; phosphates such as calcium phosphate; metal oxides such as aluminum oxide, and titanium oxide; and metal hydroxides such as aluminum hydroxide, magnesium hydroxide, and ferric hydroxide; water-soluble polymers such as polyvinyl alcohol, methyl cellulose, and gelatin; anionic surface active agents; nonionic surface active agents; and amphoteric surface active agents. Among others, the dispersion stabilizer containing a metallic compound, particularly colloid of a hardly water-soluble metal hydroxide is preferable since it can narrow a particle diameter distribution of the polymer particles and enhance an image sharpness. Particularly, where a crosslinkable monomer is not copolymerized, the dispersing stabilizer containing colloid of a hardly water-soluble metal hydroxide is favorable since it enhances dispersion stability of polymer particles during polymerization, fixing ability and shelf stability of the toner.

The dispersion stabilizer containing colloid of a hardly water-soluble metal hydroxide does not limit its production process; however, it is preferable to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase.

The colloid of the hardly water-soluble metal hydroxide used in the present invention preferably has D50 (50% cumulative value of number particle diameter distribution) of number particle diameter distribution being at most 0.5 $\mu$m and D90 (90% cumulative value of number particle diameter distribution) thereof being at most 1 $\mu$m. If the particle diameter of the colloid is too great, the stability of the polymerization is broken, and the shelf stability of the resulting polymerized toner is deteriorated.

The dispersion stabilizer is used in a proportion of ordinarily 0.1 to 20 parts by weight, preferably 0.3 to 10 parts by weight, based on 100 parts by weight of the entire amount of polymerizable monomers. If the proportion of the dispersion stabilizer used is too low, it is difficult to achieve sufficient polymerization stability whereupon the resulting polymers tend to coagulate with each other. On the other hand, if the proportion of the dispersion stabilizer used is too high, the particle diameter of the resulting polymerized toner tends to become too small.

In the aqueous dispersion medium according to the present invention, a water-soluble organic or inorganic compound may be contained as needed besides the dispersion stabilizer.

Particularly, when a water-soluble oxo acid salt is contained therein, it is preferable since the particle diameter distribution becomes sharp. As examples of the water-soluble oxo acid salts, borates, phosphates, sulfates, carbonates, silicates, and nitrates are mentioned. Among other examples, preferably mentioned are silicates, borates or phosphates, and more preferably borates. Examples of borates include sodium tetrahydroborate, potassium tetrahydroborate, sodium tetraborate, sodium tetraborate decahydrate, sodium metaborate, sodium metaborate tetrahydrate, sodium peroxoborate tetrahydrate, potassium metaborate, and potassium tetraborate octahydrate. Examples of phosphates include sodium phosphinate monohydrate, sodium phosphinate pentahydrate, sodium hydrogen phosphinate 2.5-hydrate, sodium phosphate dodecahydrate, disodium hydrogen phosphate, disodium hydrogen phosphate dodecahydrate, sodium dihydrogen phosphate monohydrate, sodium dihydrogen phosphate dihydrate, sodium hexametaphosphate, sodium hypophosphate decahydrate, sodium diphosphate decahydrate, sodium dihydrogen diphosphate, sodium dihydrogen diphosphate hexahydrate, sodium triphosphate, sodium cyclo-tetraphosphate, potassium phosphinate, potassium phosphonate, potassium hydrogen phosphonate, potassium phosphate, dipotassium hydrogen phosphate, potassium dihydrogen phosphate, potassium diphosphate trihydrate, and potassium metaphosphate. Examples of silicates include sodium metasilicate, sodium metasilicate nonahydrate, water glass, and sodium orthosilicate. An amount of any of the water-soluble oxo acid salts is ordinarily 0.1 to 1000 parts by weight, preferably 1 to 100 parts by weight, based on 100 parts by weight of hardly water-soluble inorganic compound colloid. The water-soluble oxo acid salts are dissolved in the water-based dispersion medium.

A method of changing the monomer composition A or the polymerizable composition D into droplets in the water-based dispersion medium is not particularly limited. Ordinarily, such droplets can be obtained by strongly stirring the monomer composition by using a high-speed mixer. The droplets are formed by using, for example, a turbine-type mixer represented by TK type homomixer (available from Tokushu Kika Kogyou Co., Ltd.), a device represented by Ebara Milder (available from Ebara Corporation) which stirs a dispersion in a space formed between a rotor and a stator thereof by flowing the dispersion from an inside of the rotor to an outside of the stator while the rotor in a comb-like shape and the stator which are arranged in a concentric relation with each other are rotated at a high speed, a device represented by Clear Mix CLM-0.8S (available from M. Technique Co., Ltd.) for performing homogenization by shear force generated by a rotor rotating at a high speed and a screen surrounding the rotor, collision force, pressure fluctuation, cavitation, and potential core, a device represented by TK Filmics (available from Tokushu Kika Kogyo Co., Ltd.) for performing homogenization by forcing the solution against a side wall of a homogenization vessel by means of a centrifugal force thereby forming a liquid film thereon and then contacting the resultant film with a tip of a stirring body which is rotating at an extremely high speed. A particle diameter of the thus formed droplets is homogenized approximately to the same size as that of the colored polymer particles obtained after polymerization. A particle diameter of the thus formed droplets is ordinarily 0.5 to 15 $\mu$m, preferably 1 to 10 $\mu$m.

The polymerizable monomers in the composition A or D which have been homogenized in the aqueous dispersion medium are polymerized by a polymerization initiator to obtain colored polymer particles. A polymerization reaction can be performed under an ordinary polymer polymerization condition. In order to increase the particle diameter, the polymer particles may be stirred strongly to be aggregated after such a polymerization reaction has taken place.

As polymerization initiators, mentioned are persulfates such as potassium persulfate, and ammonium persulfate; azo compounds such as 4,4'-azobis(4-cyanovaleric acid), 2,2'- azobis(2-amidinopropane) dihydrochloride, 2,2'-azobis-2-methyl-N-1,1'-bis(hydroxymethyl)-2-hydroxyethyl propionamide, 2,2'-azobis(2,4-dimethylvaleronitrile), 2,2'-azobisisobutyronitrile, and 1,1'-azobis(1-cyclohexanecarbonitrile); peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, t-butyl peroxyneodecanoate, t-hexyl peroxy-2-ethyl-hexanoate, t-butyl peroxypivalate, t-hexyl peroxypivalate, di-isopropyl peroxydicarbonate, di-t-butyl peroxyisophthalate, 1,1,3,3-tetrametyl butyl peroxy-2-ethylhexanoate, and t-butyl peroxyisobutyrate. Red-Ox initiators composed of combinations of these polymerization initiators with a reducing agent may also be used. Of these polymerization initiators, oil-soluble initiators which are soluble in polymerizable monomers used are preferably selected. Optionally, a water-soluble initiator can be used in combination with an oil-soluble initiator. The above-described polymerization initiators can be used in an amount of ordinarily 0.1 to 20 parts by weight, preferably 0.3 to 15 parts by weight, and more preferably 0.5 to 10 parts by weight based on 100 parts by weight of entire polymerizable monomers. The polymerization initiators can previously be added to the monomer composition A or the polymerizable composition D; they can optionally be added thereto after a homogenization process has been terminated.

After the colored polymer particles are obtained, a surface of the above-described colored polymer particles may further be covered with a polymer (that is shell polymer). Examplary methods of such covering with the shell polymer, are a method of adding a monomer for use in a covering polymerization to a reaction solution containing the thus-obtained colored polymer particles thereby performing a further polymerization, and a method of obtaining the colored polymer particles, adding a given polymer component to the thus-obtained colored polymer particles and allowing it to be adsorbed or fixed thereon. When a toner is produced by using core-shell type polymer particles in which the colored polymer particles are softened (for example, a glass transition temperature thereof is lowered) compared with the shell polymer, a so-called capsule type toner which has a favorable balance between low-temperature stability and high-temperature shelf stability can be obtained.

The above-described polymer particles are rinsed, dehydrated and dried. A rinsing operation is preferably performed such that an amount of a metallic ion remaining in a particle is reduced. Particularly, when a metallic ion of magnesium or calcium remains in the particle, it may occur that a toner absorbs moisture under a high humidity condition to reduce flowability thereof or to give an adverse effect to an image. The toner which has a low content of magnesium or calcium remaining in the toner (hereinafter referred to simply as residual metal) can obtain a favorable image under the conditions of high temperature and high humidity, which has a high printing density and is free from a fog by a high-speed printer having a printing capacity of at least 30 sheets a minute. An amount of the residual metal is preferably 170 ppm or less, more preferably 150 ppm or less, and most preferably 120 ppm or less. In order to reduce the amount of the residual metal, for example, when the particles are subjected to rinsing and dehydration operations, they are dehydrated and rinsed by a rinsing and dehydrating device such as a continuous belt filter or siphon-pillar-type centrifuge and thereafter dried. The resulting dried particles can optionally be classified.

The preferred toner obtained by the production method according to the present invention is substantially spherical. It is desirable that a volume average particle diameter (dv) thereof is 1 to 10 $\mu$m, preferably 3 to 8 $\mu$m; a ratio (dv/dn) of the volume average particle diameter (dv) to a number average particle diameter (dn) thereof is 1 to 1.5, preferably 1 to 1.3; a quotient (Sc/Sr) obtained by dividing an area (Sc) of a circle with a diameter being an absolute maximum length of a particle by a real projected area (Sr) of the particle is in a range of 1 to 1.3; further, a product (Ssa×dn×G) of a specific surface area (Ssa) [$m^2$/g] as measured in accordance with a BET method, the number average particle diameter (dn) [$\mu$m] and a true specific gravity (G) is in a range of 5 to 10.

A melt viscosity at 120° C. of particularly preferred toners is 100,000 poise or less, preferably 0.1 to 100,000 poise, and more preferably 1 to 80,000 poise. A viscosity measurement may be conducted by a flow tester. When toners having such a melt viscosity are employed, a high quality image can be obtained even by high-speed printing.

Further, the colored polymer particle may be treated with an outer-additive. By attaching an outer-additive on a surface of the particle, or sticking it in the particle, a charge property, flowability, and shelf stability of the particle can be adjusted.

As outer-additives, mentioned are inorganic particles, organic acid salt particles, and organic resin particles. Examples of the inorganic particles include silicon dioxide, aluminum oxide, titanium oxide, zinc oxide, tin oxide, barium titanate, and strontium titanate. Examples of the organic acid salt particles include zinc stearate, and calcium stearate. Examples of the organic resin particles include polymer particles of methacrylate, polymer particles of acrylate, copolymer particles of styrene-methacrylate, copolymer particles of styrene-acrylate, core-shell type polymer particles having a shell formed of a methacrylate copolymer and a core formed of a styrene polymer. Among these outer-additives, the inorganic particles, particularly silicon dioxide particles, are preferable. The surface of these particles may be reformed by hydrophobic treatment. The hydrophobic reformed particles, particularly the hydrophobic reformed silicon dioxide particles, are preferable. An amount of the outer-additives is not particularly limited, but is ordinarily 0.1 to 6 parts by weight, based on 100 parts by weight of the colored polymer particles. The outer-additives can be used individually or in combination. When the outer-additives are used in combination, it is preferable to use different types of inorganic particles different in average particle diameters from each other, or a combination of inorganic particles and organic resin particles. In order to fix the outer-additive on the surface of the colored polymer particles, the outer-additive and the colored polymer particles are charged in a mixer such as Henschel mixer for stirring.

The present invention will hereinafter be described more specifically by the following Examples and Comparative Examples. However, the present invention should not be interpreted to be limited to these Examples in any way. Unless stated otherwise, all parts and percentages are given by weight.

Physical properties in the following Examples and Comparative Examples were measured in accordance with the following respective methods.

(1) Particle Diameter, and Ratios of Coarse Powders and Fine Powders

A volume average particle diameter (dv), a number average particle diameter (dn), a coarse powder ratio and a fine powder ratio of polymer particles (=toner particles) were measured by means of Multisizer (available from Beckman- Coulter Inc.). The measurement by Multisizer was conducted under the following conditions:

aperture diameter: 100 μm;

medium: Isotone II;

concentration: 10%;

number of particles subjected to measurements: 100,000.

A ratio of 16 μm or more on a cumulative curve of the volume average particle diameter obtained by using the above-described measuring device is determined as coarse powder ratio (volume %) while a ratio of 5 μm or less on a cumulative curve of the number average particle diameter is determined as fine powder ratio (number %).

(2) Evaluation of Image

After a non-magnetic one-component developing system printer (12 sheet device) was allowed to stand for one whole day(24 hours) under environmental conditions of 23° C. and 50% moisture, printing was continuously conducted from the beginning until specific sheets were printed and then half-tone printing was subsequently conducted until the total number of printed sheets reached 10,000 for evaluating printing density and fog. Quality of the printed images were evaluated by the following index:

Printing density was evaluated and recorded by a small circle denoting good; a delta denoting some inferior characteristics; and an x denoting generally inferior. Fog was evaluated and recorded by a small circle denoting good; a delta denoting some inferior characteristics; and an x denoting generally inferior.

EXAMPLE 1

20 parts of carbon black (available from Mitsubishi Chemical Corporation under the trade name of "#25B") were added to 80 parts of styrene and mixed to prepare a mixture; the resulting mixture was dispersed by using an overflow-type horizontal cylindrical media-type dispersing device which was previously filled with steel beads as media having a diameter of 1.5 mm and a density of 7.4 g/cm$^3$ at an apparent filling rate of 75 volume % under conditions that a tip speed of a stirring body of the media-type dispersing device was about 9 m/s, a residence time of the mixture was 0.1 hour. an apparent linear velocity was 0.16 m/min and a temperature in the dispersing device was about 35° C. such that a viscosity of the mixture became to be about 4 times the viscosity of the mixture before dispersed to obtain a monomer composition A. The viscosity of the monomer composition A before dispersed and that of the monomer composition A after dispersed were 22 mPa·s and 86 mPa·s, respectively.

Separately, 10 parts of a charge control agent (available from Hodogaya Chemical Co., Ltd. under the trade name of "Spiron Black TRH") were dispersed in 90 parts of styrene under same conditions as the above-described conditions to obtain a monomer composition B.

Further separately, 10 parts of a parting agent (Fischer-Tropsh wax having an endothermic peak temperature of 100° C.; available from Sasol Incorporated under the trade name of "Paraflint Spray 30") were dispersed in 90 parts of styrene under same conditions as the above-described conditions to obtain a monomer composition C.

35 parts of the monomer composition A (containing 7 parts of #25B), 10 parts of the monomer composition B (containing 1 part of Spiron Black TRH) and 20 parts of the monomer composition C (containing 2 parts of Paraflint Spray 30) were mixed to prepare a mixture into which 28 parts of styrene, 17 parts of n-butylacrylate, 0.3 part of polymethacrylic ester macromonomer (available from Toagosei Chemical Industry Co. Ltd. under the trade name of "AA6" having a Tg of 94° C.), 0.5 part of divinylbenzene and 1.2 part of t-dodecylmercaptan were added and mixed in a mixing tank. An initial viscosity of the resultant mixture was 10 mPa·s. Then, the resultant mixture was subjected to dispersion processing under same conditions as the above-described conditions to obtain a polymerizable composition D. A viscosity thereof after such processing was 41 mPa·s.

On the other hand, an aqueous solution with 6.2 parts of sodium hydroxide dissolved in 50 parts of ion-exchanged water was gradually added to an aqueous solution with 10.2 parts of magnesium chloride dissolved in 250 parts of ion-exchanged water under stirring to prepare a colloidal solution of magnesium hydroxide. A particle diameter distribution of colloids in the thus prepared colloidal solution was measured by means of a microtrack particle diameter distribution measuring device (available from Nikkiso Co., Ltd.) and found to be 0.35 μm in terms of D50 (50% cumulative value of number particle diameter distribution) and 0.84 μm in terms of D90 (90% cumulative value of number particle diameter distribution). Measurement by means of the microtrack particle diameter distribution measuring device was performed under the following conditions:

measuring range: 0.12 to 704 μm;

measuring time: 30 seconds; and medium: ion-exchanged water.

The polymerizable composition D prepared above was added into the colloidal solution of magnesium hydroxide obtained above and stirred until droplets formed came to be in a stable state; then, 6 parts of t-butyl peroxy-2-ethylhexanoate were added to the thus mixed, stirred solution to prepare a mixture; subsequently, the thus-prepared mixture was subjected to droplets homogenization processing by means of Ebara Milder MDN303V (available from Ebara Corporation) under conditions that a rotation rate of a rotor was 12,000 rpm, a flow rate of the mixture was 120 liters/hour, and the mixture was forced to pass through the Ebara Milder five times repeatedly to prepare an aqueous solution in which droplets were formed; thereafter, the thus-prepared aqueous solution containing droplets of the polymerizable composition D was charged into a reactor equipped with an agitating blade to initiate a polymerization reaction at 85° C.; then, after the polymerization reaction was allowed to proceed for 4 hours holding a reaction temperature at 90° C., the reaction was terminated to obtain an aqueous dispersion of polymer particles.

The thus-obtained aqueous dispersion of the polymer particles was rinsed with sulfuric acid (25° C. for 10 minutes) while stirring to adjust the pH thereof to be 6 or less. The dispersion was subjected to filtration-separation processing (filtration processing, rinsing processing and dehydration processing) to collect a solid content. The thus-collected solid content was dried at 45° C. for 2 days by a dryer to obtain colored polymer particles.

To 100 parts of the thus-obtained colored polymer particles, added was 0.8 part of silica having an average particle diameter of 14 nm (available from Nippon Aerosil Co., Ltd. under the trade name of "RX200") which had been subjected to a hydrophobicity-imparting treatment; the resultant mixture was mixed by means of a Henschel mixer to prepare a toner for electrophotography. Evaluation results thereof are shown in Table 1.

TABLE 1

| | Examples | | Comparative Examples | |
|---|---|---|---|---|
| | 1 | 2 | 1 | 2 |
| Residence times (hours) | 0.1 | 0.26 | 0.02 | 0.70 |
| Tip speeds of stirring body (m/s) | 9 | 17 | 22 | 2 |
| Monomer composition A | | | | |
| Initial viscosities (mPa · s) | 22 | 22 | 22 | 22 |
| Viscosities after processed (mPa · s) | 86 | 180 | 54 | 38 |
| Polymerizable composition D | | | | |
| Initial viscositics (mPa · s) | 10 | 15 | 8 | 8 |
| Viscosities after processed (mPa · s) | 41 | 86 | 28 | 21 |
| Particle diameter distributions | | | | |
| dv (μm) | 7.6 | 7.9 | 9.6 | 8.2 |
| dv/dn (-) | 1.19 | 1.15 | 1.65 | 1.53 |
| Rates of coarse powders (%) | 2.2 | 2.8 | 5.0 | 4.5 |
| Rates of fine powders (%) | 14.8 | 15.8 | 35.8 | 23.7 |
| Printing density | ○ | ○ | Δ | Δ |
| Fog | ○ | ○ | x | x |

EXAMPLE 2

A dispersion was obtained in the same manner as in Example 1 except that the tip speed value of the stirring body was changed into about 17 m/s, and the residence time was changed into 0.26 hour. The initial viscosity of the monomer composition A was 22 mPa·s while the viscosity thereof after processed was 180 mPa·s. The initial viscosity of the polymerizable composition D was 15 mPa·s while the viscosity thereof after processed was 86 mPa·s. Evaluation results are shown in Table 1.

Comparative Example 1

A dispersion was obtained in the same manner as in Example 1 except that the tip speed value of the stirring body was changed into about 22 m/s, and the residence time was changed into 0.02 hour. The initial viscosity of the monomer composition A was 22 mPa·s while the viscosity thereof after processed was 54 mPa·s. The initial viscosity of the polymerizable composition D was 8 mPa·s while the viscosity thereof after processed was 28 mPa·s. Evaluation results are shown in Table 1.

Comparative Example 2

A dispersion was obtained in the same manner as in Example 1 except that the tip speed value of the stirring body was changed to about 2 m/s, and the residence time was changed to 0.7 hour. The initial viscosity of the monomer composition A was 22 mPa·s while the viscosity thereof after processed was 38 mPa·s. The initial viscosity of the polymerizable composition D was 8 mPa·s while the viscosity thereof after processed was 21 mPa·s. Evaluation results are shown in Table 1.

According to the production method of the present invention, a toner excellent in electric charge amount distribution causing no fog can efficiently be obtained. This toner can favorably be used in a high-speed printer or a high-speed copier.

What is claimed is:

1. A method for producing a toner comprising the steps of:

dispersing a colorant in a dispersion medium essentially composed of a polymerizable monomer with a media-type dispersing device at a tip speed of a stirring body of about 3 to 20 m/s with a residence time being about 0.03 to 0.5 hour to obtain a monomer composition A;

homogenizing said composition A in an aqueous dispersion medium containing a dispersion stabilizer to generate droplets; and polymerizing said droplets to obtain colored polymer particles.

2. The method for producing a toner according to claim 1, wherein the tip speed of a stirring body is about 8 to 20 m/s.

3. The method for producing a toner according to claim 1, wherein the residence time is about 0.05 to 0.3 hour.

4. The method for producing a toner according to claim 1, wherein a diameter of media filled in the media-type dispersing device is about 0.1 to 20 mm.

5. The method for producing a toner according to claim 1, wherein a density of a bead as the media filled in the media-type dispersing device is about 3 to 9 g/cm$^3$.

6. The method for producing a toner according to claim 1, wherein the amount of residual metal in the colored polymer particles is not more than about 170 ppm.

7. The method for producing a toner according to claim 1, wherein a viscosity of the monomer composition A obtained after dispersion is less than 10 times that of said monomer composition A before dispersion.

8. The method for producing a toner according to claim 1, wherein a temperature of said monomer composition A to be dispersed in said media-type dispersing device is about 0 to 50° C.

9. The method for producing a toner according to claim 1, wherein the polymerizable monomer is styrene monomer and/or ethylenically unsaturated carboxylic acid ester monomer.

10. A method for producing a toner comprising the steps of:

dispersing a colorant in a dispersion medium (a) essentially composed of a polymerizable monomer with a media-type dispersing device at a tip speed of a stirring body of about 3 to 20 m/s with a residence time being about 0.03 to 0.5 hour to obtain a monomer composition A;

dispersing or dissolving a charge control agent in a dispersion medium (b) essentially composed of a polymerizable monomer to obtain a monomer composition B;

dispersing or dissolving a parting agent in a dispersion medium (c) essentially composed of a polymerizable monomer to obtain a monomer composition C;

mixing or dispersing the monomer composition A, the monomer composition B and the monomer composition C in a dispersion medium (d) essentially composed of a polymerizable monomer to obtain a polymerizable composition D;

homogenizing to form droplets of said polymerizable composition D in an aqueous dispersion medium containing a dispersion stabilizer; and polymerizing said droplets to obtain colored polymer particles.

11. The method for producing a toner according to claim 10, wherein a residence time is about 0.05 to 0.3 hour.

12. The method for producing a toner according to claim 10, wherein a diameter of media in the media-type dispersing device is about 0.1 to 20 mm.

13. The method for producing a toner according to claim 10, wherein a density of a bead as the media in the media-type dispersing device is about 3 to 9 g/cm$^3$.

14. The method for producing a toner according to claim 10, wherein the amount of residual metal in the colored polymer particles is not more than about 170 ppm.

15. The method for producing a toner according to claim 10, wherein a viscosity of the monomer composition A obtained after dispersion is less than 10 times that of said monomer composition A before dispersion.

16. The method for producing a toner according to claim 10, wherein a temperature of said monomer composition A to be dispersed in said media-type dispersing device is about 0 to 50° C.

17. The method for producing a toner according to claim 10, wherein a viscosity of the polymerizable composition D obtained after dispersed is less than 10 times that of said polymerizable composition D before dispersed.

18. The method for producing a toner according to claim 10, wherein the polymerizable monomer is styrene monomer and/or ethylenically unsaturated carboxylic acid ester monomer.

19. The method for producing a toner according to claim 10, wherein the colorant is selected from a group consisting of black colorants, magenta colorants, yellow colorants and cyan colorants.

20. The method for producing a toner according to claim 10, wherein the charge control agent is a charge control resin.

* * * * *